US006475121B2

(12) United States Patent
Wang et al.

(10) Patent No.: US 6,475,121 B2
(45) Date of Patent: Nov. 5, 2002

(54) ELEVATING APPARATUS OF AN EXERCISE TREADMILL

(76) Inventors: Leao Wang; Peter Wu, both of No. 1, Lane 233, Sec. 2, Charng Long Rd., Taiping (TW)

( * ) Notice: Subject to any disclaimer, the term of this patent is extended or adjusted under 35 U.S.C. 154(b) by 0 days.

(21) Appl. No.: 09/760,337

(22) Filed: Jan. 16, 2001

(65) Prior Publication Data

US 2002/0094916 A1 Jul. 18, 2002

(51) Int. Cl.[7] ..... A63B 22/00
(52) U.S. Cl. ..... 482/54; 482/51
(58) Field of Search ..... 482/51, 54

(56) References Cited

U.S. PATENT DOCUMENTS 5,772,560 A * 6/1998 Waterson et al. ..... 482/54
6,015,368 A * 1/2000 Clem et al. ..... 482/54
6,261,209 B1 * 7/2001 Coody ..... 482/54

* cited by examiner

*Primary Examiner*—Glenn E. Richman
(74) *Attorney, Agent, or Firm*—Troxell Law Office PLLC; Kuo-Hsiung Chiu

(57) ABSTRACT

The present invention relates to an elevating apparatus of an exercise treadmill. The elevating apparatus utilizes a servo-motor to drive a transmission spindle into rotation by a gearbox, thereby driving a slide shaft to move to and fro between two base bars of the main frame. At least two lift shafts are pivotably connected to one end of the slide shafts while the other end thereof is pivotably connected to folding bars. Either folding bar is L-shaped and includes a first, a second and a third pivoting members. Moreover, the first pivoting member is pivotally mounted on the deck, the second pivoting member is pivotally mounted on the main frame and the third pivoting member is selectively pivotally attached to the deck by a latch. Accordingly, when the third pivoting member is separated from the deck, the elevating apparatus will perform an elevating action to be located at an inclined position. And when the third pivoting member is positioned in the pivoting hole of the deck, the elevating apparatus will perform a folding action to be located at a substantially upright position.

6 Claims, 6 Drawing Sheets

ELEVATING APPARATUS OF AN EXERCISE TREADMILL

BACKGROUND OF THE INVENTION

1. Field of the Invention

The present invention relates to an exercise treadmill, and more particularly, to an exercise treadmill whose deck is selectively raised or lowered for temporary storage or for use during an exercise session.

2. Description of the Prior Art

The conventional exercise treadmill is used for in-place walking, jogging, and running exercise. In order to promote its functions, an elevator assembly for a fold-up treadmill, as shown in FIGS. 5 and 6, is developed. The elevator assembly comprising two elevating tubes, a connecting rod, two slide rails, a drive apparatus and a telescopic rod is interposed between a deck and a base. The telescopic rod is driven by the drive apparatus into rotation so that a spindle makes a telescopic movement in a sleeve for extending and retracting the connecting rod. Accordingly, the elevating tubes pivotably move along a bottom rod of the base for elevating the deck. However, the elevating action of this conventional assembly takes a longer time, thereby increasing the load of the motor during the transmission session and shortening the operational life thereof. In addition, the spindle is inclinedly disposed in the sleeve for the telescopic movement while the other end of the sleeve is attached to the connecting rod so that the spindle shakes with the increasing length to the sleeve when the telescopic rod extends and retracts the connecting rod.

Furthermore, the aforementioned treadmill only provides the elevating function to the deck. However, the deck has to be manually folded for storage or transportation. It's inconvenient, time-wasting and energy-wasting. Although the exercise treadmill with a foldable deck for storage and for use during an exercise session is available on the market, it is configured with two motors and two drive units. As a result, its configuration is complex and its production is costly.

SUMMARY OF THE INVENTION

It is a primary object of the present invention to provide an elevating apparatus for an exercise treadmill by which an elevating and a folding function are available to meet different requirements of users.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
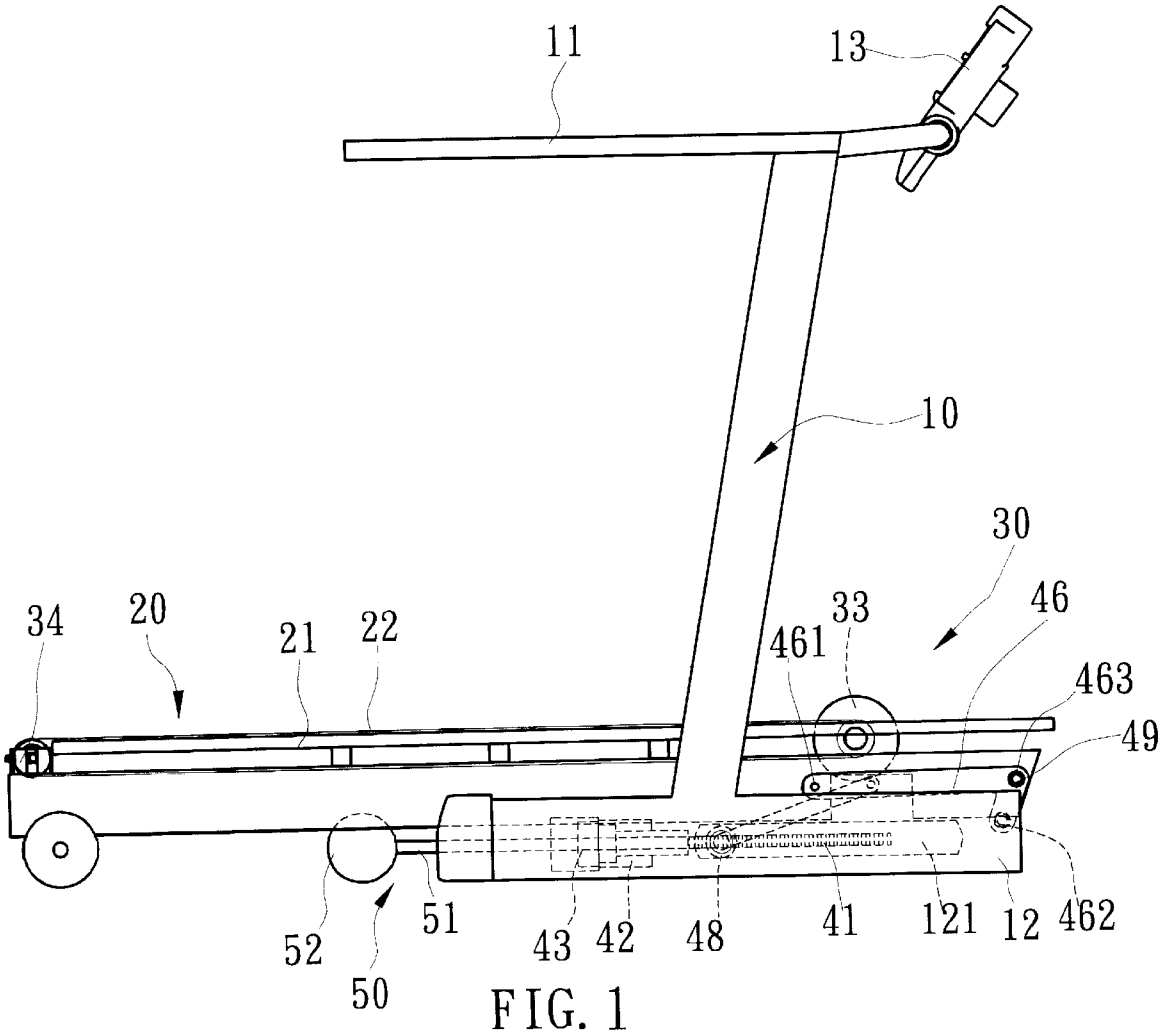
FIG. 1 is a side view of the present invention after assembly
Figure 2:
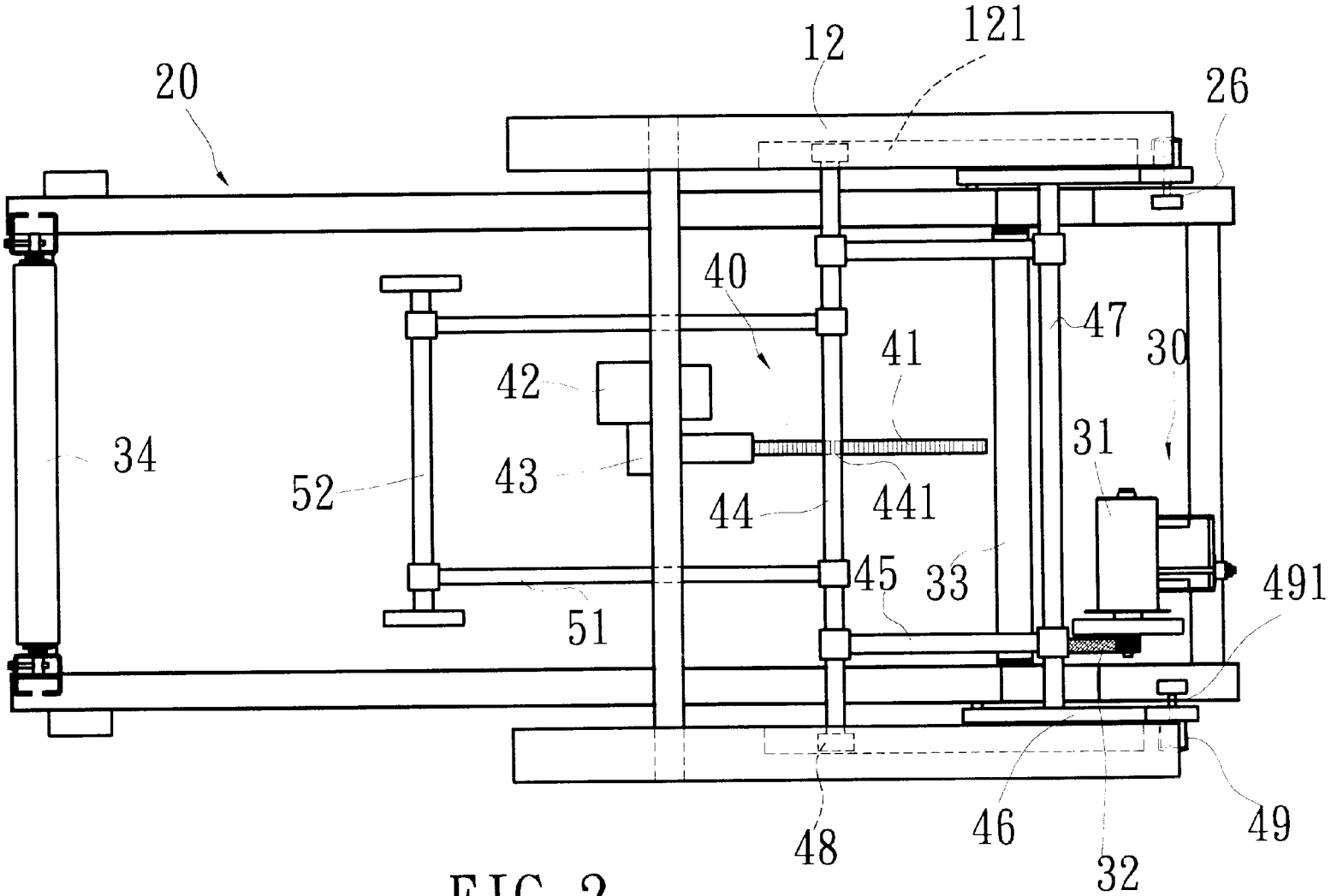
FIG. 2 is a bottom view of the present invention after assembly.

First of all, referring to FIGS. 1 and 2, the elevating apparatus of an exercise treadmill in accordance with the present invention includes a main frame 10, a deck 20, a deck transmission assembly 30 and an elevating apparatus 40.

The main frame 10 includes a U-shaped handrail 11 and two opposing base bars 12. A control panel 13 is mounted on the U-shaped handrail 11 while each of base bars 12 includes a slide rail 121 at opposing sides thereof.

The deck 20 positioned between two base bars 12 of the main body 10 comprises a running bed 21 and a running belt 22.

The deck transmission assembly 30 arranged on the deck 20 includes a main motor 31, a belt wheel 32 and a primary transmission shaft 33 and a secondary transmission shaft 34. The main motor 31 drives the belt wheel 32 for continuously rotating a running belt 22.

The folding mechanism 40 includes a transmission spindle 41 driven by a servomotor 42 and a gearbox 43. A slide shaft 44, two lift shafts 45 and two folding bars 46 are provided and driven by the transmission spindle 41 to make a to-and-fro sliding movement.

One end of the transmission spindle 41 is inserted through a threaded hole 441 to be pivotably connected to the slide shaft 44.

The slide shaft 44 includes a roller 48 at either end thereof. The roller 48 are positioned on the slide rails 121 of the main frame 10. Moreover, one end of either lift shaft 45 is pivotally mounted to the slide shaft 44 while the other end thereof is pivotably attached to the folding bars 46 by means that a fixing shaft 47 is laterally provided.

Either folding bar 46 is L-shaped and includes a first, a second and a third pivoting members 461, 462, 463. The first pivoting member 461 is pivotally mounted on the deck 20 and the second pivoting member 462 is pivotally mounted on the main frame 10 while the third pivoting member 463 is selectively pivotally attached to the deck 20 by means of a latch 49. A pivoting head 491 is extended at one end of the latch 49 and fits a pivoting hole 23 at one side of the deck 20.

Figure 3:
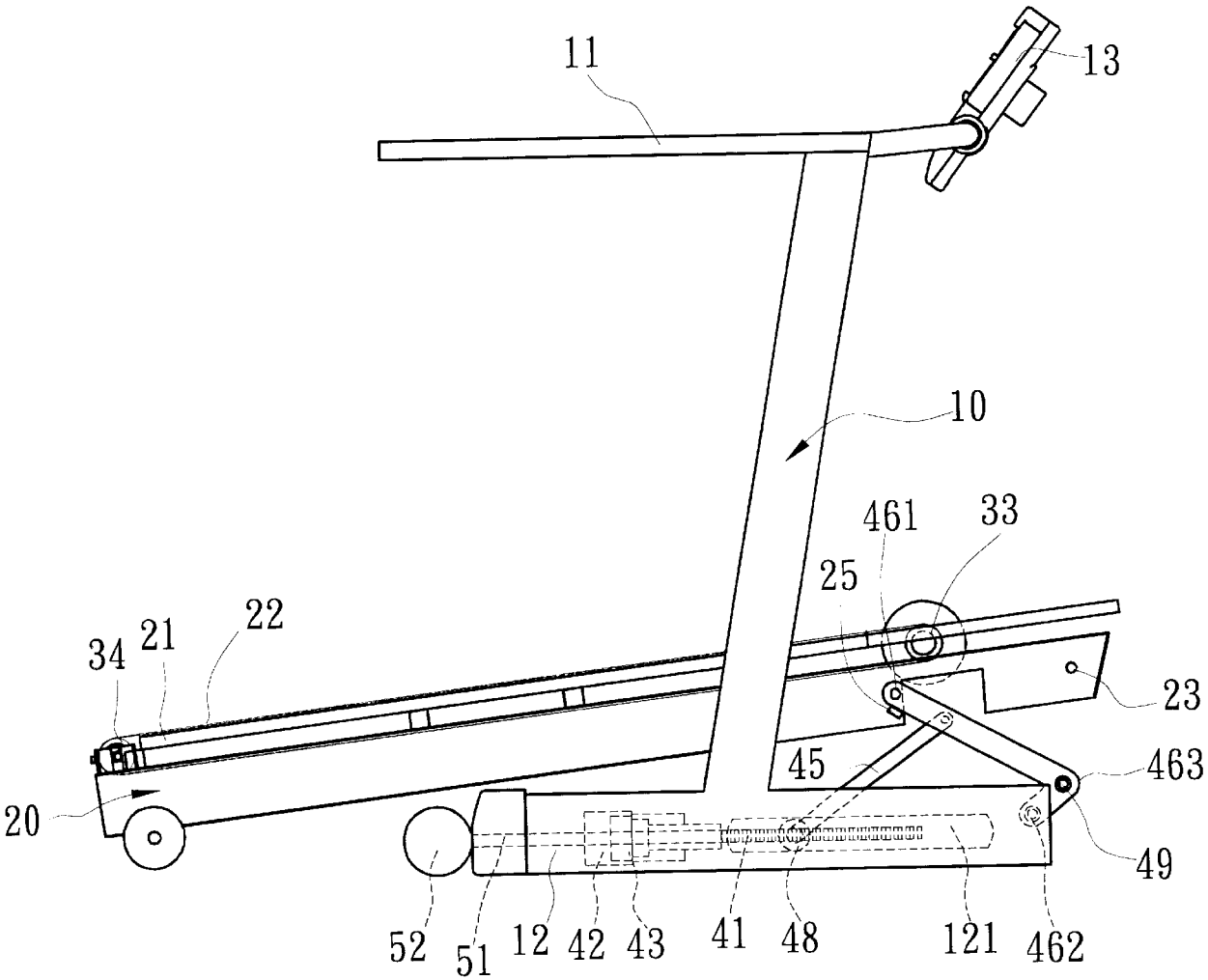
FIG. 3 is a side view of the present invention elevated for use during an exercise session.
Figure 4:
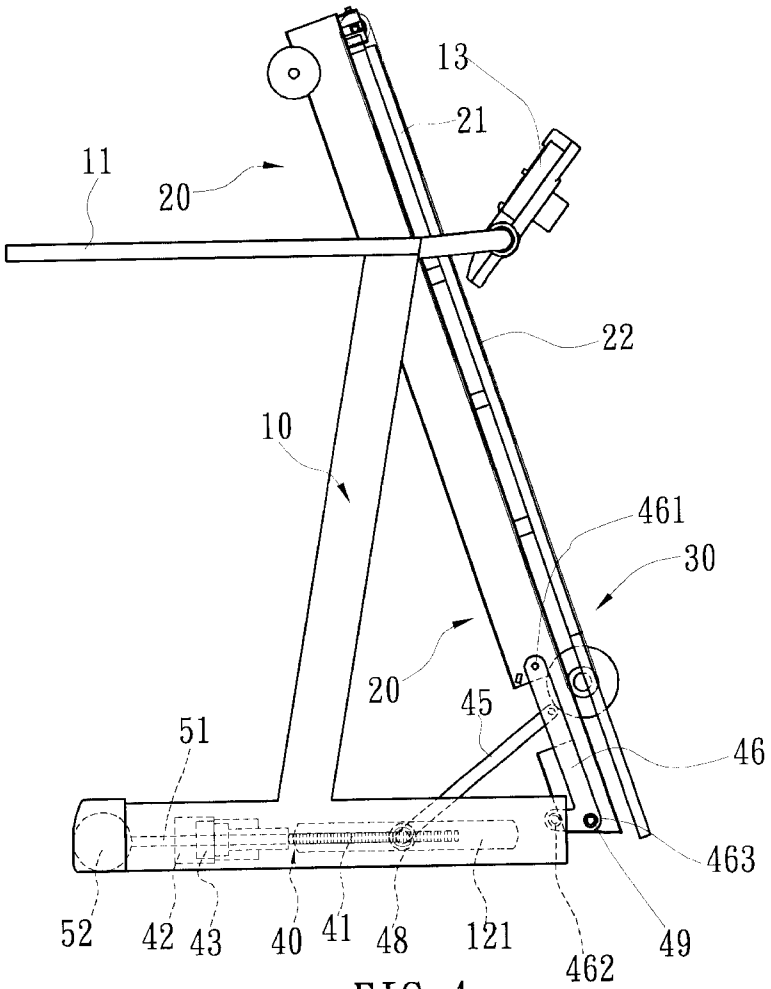
FIG. 4 is a side view of the present invention elevated for temporary storage.
Figure 5:
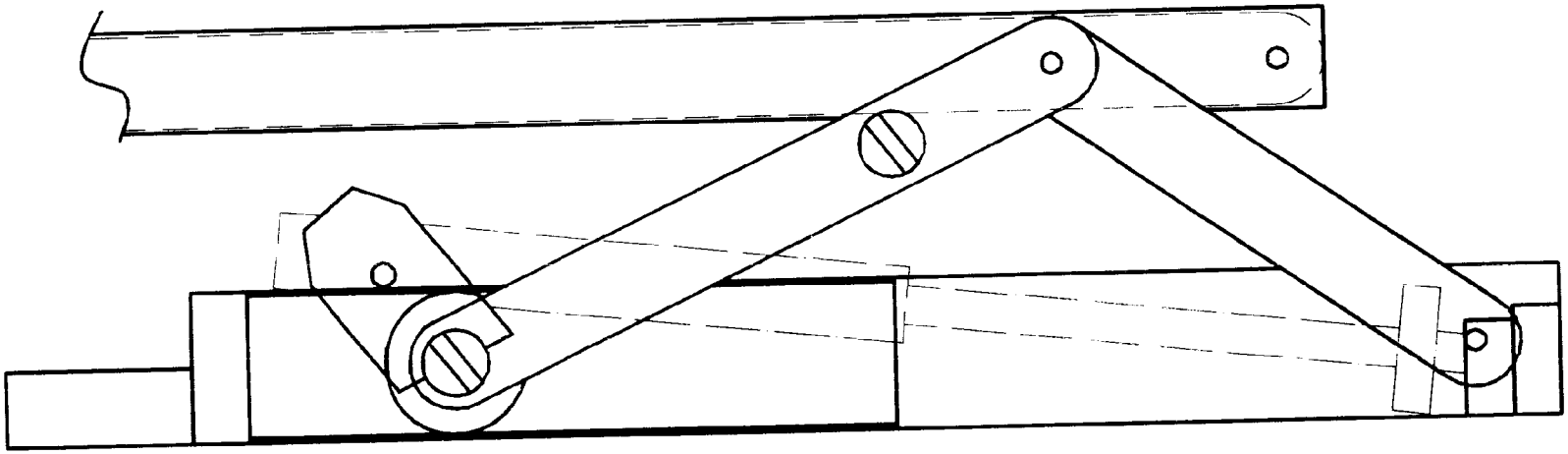
FIG. 5 PRIOR ART
FIG. 5 is a schematic drawing of a conventional elevating apparatus before the raising action.
Figure 6:
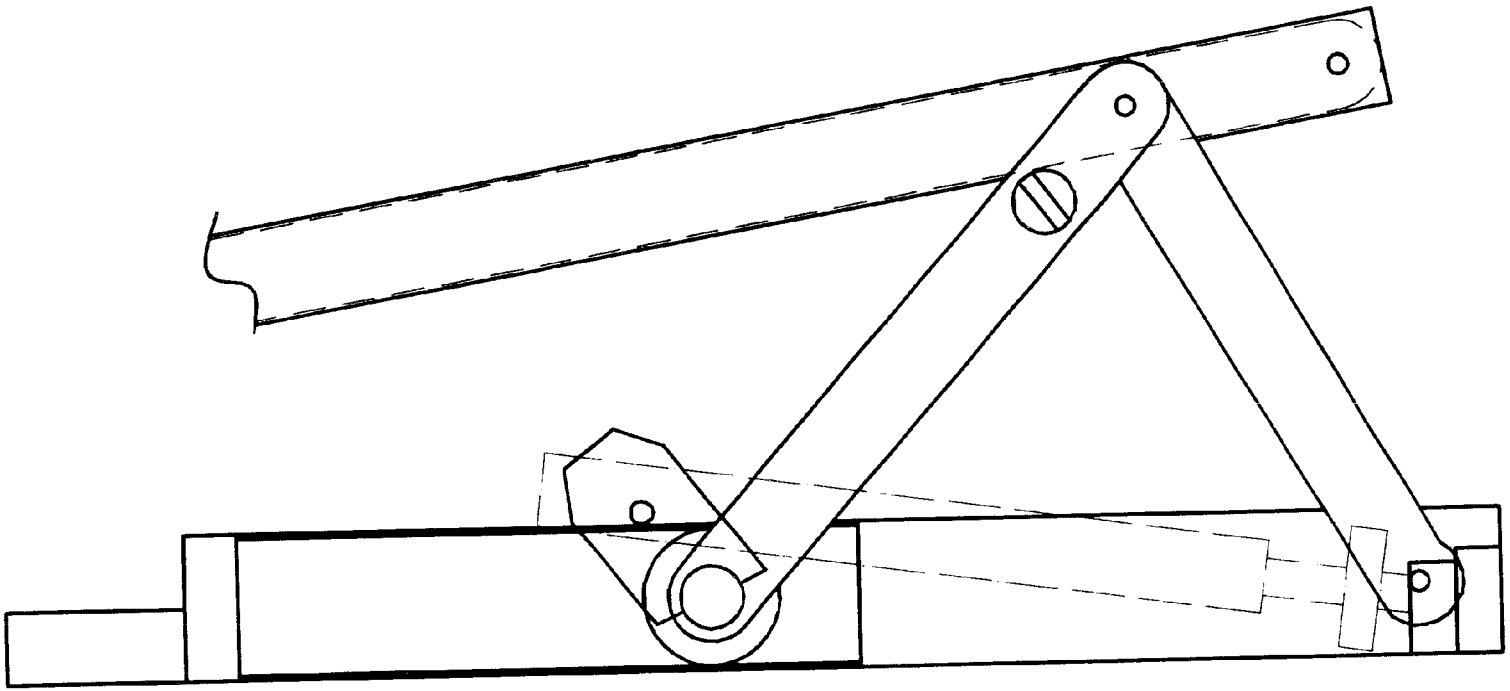
FIG. 6 PRIOR ART
FIG. 6 is a schematic drawing of a conventional elevating apparatus after the raising action.

Accordingly, referring to FIG. 3, when the third pivoting member 463 of the folding bars 46 is separated from the deck 20, the slide shaft 44 is driven for a to-and-fro movement by means of the elevating apparatus 40 such that the front end of the deck 20 folds up to an inclined position. Moreover, when the third pivoting member 463 is positioned in the pivoting hole 23 of the deck 20, the to-and-fro movement of the slide shaft 44 allows the rear end of the deck 20 to fold up to a substantially upright position (see FIG. 4).

As described above, the advantage of the present invention lies in that the deck 20 can be selectively lifted or folded only by means of the elevating apparatus 40. Moreover, a larger incline of the deck 20 is created only by a little movement of the slide shaft 44. Therefore, the present invention is more practical and progressive than the conventional products.

In order to avoid false actions during the elevating or folding session of the deck 20, an electronic sensor is provided at the pivoting hole 23 of the deck 20 and is connected to the power supply system (not shown) of the main motor. Accordingly, when the electronic sensor 24 is touched by the latch 49, the main motor 31 will be immediately switched off.

Furthermore, a limit switch 25 is fitted at a proper position of two sides of the deck 20 and connected to the power supply (not shown) of the servomotor 42. This limit switch 27 is used to limit the maximal elevating angle of the deck 20 when the folding bars 46 are elevated to the preset height and in contact therewith.

Moreover, an auxiliary folding assembly 50 including two parallel connection bars 51 and a movable support 52 is pivotably connected to the slide shaft 44. One end of the connection bars 51 is pivotably connected to the slide shaft 44 while the movable support 52 is fixed at the other end of the connection bars 51 and serves as a component having the sliding feature, allowing the movable support 52 to slide with the slide shaft 44 between the base bars 12 of the main frame 10. When the deck 20 folds up, the movable support 52 of the auxiliary folding assembly 50 is permanently situated behind the center of gravity of the deck 20. Accordingly, the deck 20 folds up more smoothly.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A folding and elevating electric exercise treadmill comprising:

a) a main frame having an inverted U-handrail and two opposing base bars;

b) a deck having front and rear end portions, the front end portion interposed between the two base bars, and including a running belt mounted around said deck, the deck being movable between a use position and a folded position;

c) a belt-driving assembly mounted at one end of said deck, including a main motor driving a belt wheel which rotates a drive shaft to move said running belt; and, d) an elevating folding unit interposed between the two base bars, and including: a servomotor driving a gear box which rotates a transmission spindle, said transmission spindle engaging a slide shaft slidably mounted to the base bars such that said slide shaft undergoes forward and backward movement; two L-shaped folding bars, each pivotally connected to said deck and one of the two base bars; and two lift shafts, each pivotally connected to the slide shaft and to one of the L-shaped folding bars at a location different from the pivotal connection between the L-shaped folding bar and the deck; and, e) a releasable latching mechanism interposed between the folding bars and the deck whereby the folding bars can be selectively fixedly connected to the deck, whereby, when the folding bars are fixedly connected to the deck, the elevating unit moves the deck between the use and storage positions.

2. The folding and elevating exercise treadmill of claim 1 further comprising an auxiliary folding assembling including at least one connection bar connected to and movable with the slide shaft and extending toward the rear end portion of the deck, and a movable support bar mounted to the at least one connection bar, the movable support bar being an auxiliary support for the main frame as the rear end portion of the deck is moved between the use position and the folded position.

3. The folding electric exercise treadmill of claim 2 wherein the movable support bar is located between the two opposing base bars when the deck is in the folded position.

4. The folding and elevating electric exercise treadmill as claimed in claim 1, wherein said slide shaft includes a screw hole engaged by said transmission spindle so that said slide shaft is movable when said transmission spindle rotates.

5. The folding and elevating electric exercise treadmill as claimed in claim 1, further comprising an electronic sensor provided on the deck and connected with a power supply system of said main motor, wherein the power of said main motor is disconnected when the electronic sensor contacts the latching mechanism.

6. The folding and elevating electric exercise treadmill as claimed in claim 1, further comprising a limit switch on said deck and connected to said servomotor, such that, when a predetermined maximal elevation angle of said deck is reached and when said folding bars are elevated to a preset height the servomotor is turned off.

* * * * *